US008979517B2

(12) United States Patent
Omura et al.

(10) Patent No.: US 8,979,517 B2
(45) Date of Patent: Mar. 17, 2015

(54) ROTARY COMPRESSOR HAVING SEMICIRCULAR-STEP-SNAP ENLARGED DIAMETER PORTION IN GROOVE PORTION OF END PLATE CLOSING END PORTION OF CYLINDER

(71) Applicant: Fujitsu General Limited, Kawasaki-shi, Kanagawa (JP)

(72) Inventors: Takayuki Omura, Kawasaki (JP); Taku Morishita, Kawasaki (JP)

(73) Assignee: Fujitsu General Limited, Kawasaki-Shi, Kanagawa (JP)

( * ) Notice: Subject to any disclaimer, the term of this patent is extended or adjusted under 35 U.S.C. 154(b) by 0 days.

(21) Appl. No.: 13/940,180

(22) Filed: Jul. 11, 2013

(65) Prior Publication Data

US 2014/0093414 A1 Apr. 3, 2014

(30) Foreign Application Priority Data

Sep. 28, 2012 (JP) ..... 2012-218484

(51) Int. Cl.

| | |
|---|---|
| ***F01C 21/10*** | (2006.01) |
| ***F03C 2/00*** | (2006.01) |
| ***F03C 4/00*** | (2006.01) |
| ***F04C 2/00*** | (2006.01) |
| ***F04C 18/332*** | (2006.01) |
| ***F04C 29/12*** | (2006.01) |
| ***F04C 18/356*** | (2006.01) |

(52) U.S. Cl.

CPC ..... *F04C 18/332* (2013.01); *F04C 29/12* (2013.01); *F04C 18/356* (2013.01); *F04C 29/128* (2013.01)

USPC ..... 418/150; 418/11; 418/60; 418/63; 418/270

(58) Field of Classification Search

USPC ..... 418/11, 60, 63, 270, 150

See application file for complete search history.

(56) References Cited

U.S. PATENT DOCUMENTS

| | | | |
|---|---|---|---|
| 4,955,797 | A | 9/1990 | Cowen |
| 5,035,050 | A | 7/1991 | Cowen |

(Continued)

FOREIGN PATENT DOCUMENTS

| | | | |
|---|---|---|---|
| EP | 2161454 | A2 | 3/2010 |
| JP | 08-200264 | | 8/1996 |

(Continued)

OTHER PUBLICATIONS

European Search Report EP Application No. 13177128.9 dated Jun. 23, 2014.

*Primary Examiner* — Theresa Trieu

(74) *Attorney, Agent, or Firm* — McDermott Will & Emery LLP

(57) ABSTRACT

A rotary compressor, used e.g. in an air conditioner, includes a compressing unit having an end plate that closes an end portion of an annular cylinder. The end plate includes a groove portion accommodating a discharge valve portion having a reed valve type discharge valve and a discharge-valve limiter. The discharge valve portion is attached to the groove portion with a rivet. The groove portion has a rivet-side enlarged diameter portion formed into a semicircular step shape, and a diameter of the rivet-side enlarged diameter portion other than a bottom side thereof is larger than a diameter of the bottom side. This prevents a punch P that swages the rivet from interfering with the groove portion when attaching the discharge valve portion to the groove portion with the rivet.

1 Claim, 6 Drawing Sheets

(56) References Cited

U.S. PATENT DOCUMENTS

| | | | |
|---|---|---|---|
| 5,775,894 | A | 7/1998 | Kosco, Jr. |
| 6,261,073 | B1 | 7/2001 | Kumazawa |
| 6,513,544 | B1 | 2/2003 | Farag et al. |
| 2002/0119059 | A1 | 8/2002 | Sato et al. |

FOREIGN PATENT DOCUMENTS

| | | | |
|---|---|---|---|
| JP | 2001-280241 | A | 10/2001 |
| JP | 2004-239273 | | 8/2004 |

ROTARY COMPRESSOR HAVING SEMICIRCULAR-STEP-SNAP ENLARGED DIAMETER PORTION IN GROOVE PORTION OF END PLATE CLOSING END PORTION OF CYLINDER

CROSS-REFERENCE TO RELATED APPLICATIONS

This application is based upon and claims the benefit of priority from Japanese Patent Application No. 2012-218484, filed on Sep. 28, 2012, the entire contents of which are incorporated herein by reference.

BACKGROUND OF THE INVENTION

1. Field of the Invention

The present invention relates to a rotary compressor used, for example, in an air conditioner.

2. Description of the Related Art

In a conventional rotary compressor, first and second groove portions 563S and 563T (see FIG. 7) are formed in a lower end plate 160S and an upper end plate 160T of a compressing unit 12 (see FIG. 1), respectively. The first and second groove portions 563S and 563T accommodate reed valve type first and second discharge valves 200S and 200T, which open and close first and second discharge openings 190S and 190T, and first and second discharge-valve limiters 201S and 201T, which are used to limit valve-opening amount of the first and second discharge valves 200S and 200T when they are deflected (hereinafter, deflection opening amount of the first and second discharge valves 200S and 200T), respectively. Furthermore, the first and second groove portions 563S and 563T are formed such that the first and second discharge valves 200S and 200T and the first and second discharge-valve limiters 201S and 201T are attached with first and second rivets 203S and 203T, respectively (see FIGS. 7 and 8).

On the side the first and second discharge openings 190S and 190T of the first and second groove portions 563S and 563T, the diameter (width) of the first and second groove portions 563S and 563T is enlarged so as to form first and second discharge-opening-side enlarged diameter portions 563Sb and 563Tb, respectively. Also on the side of the first and second rivets 203S and 203T, the diameter (width) of the first and second groove portions 563S and 563T is enlarged so as to form first and second rivet-side enlarged diameter portions 563Sa and 563Ta, respectively.

As illustrated in FIG. 8, the first and second discharge valves 200S and 200T and the first and second discharge-valve limiters 201S and 201T are attached to the inside of the first and second groove portions 563S and 563T (the first and second rivet-side enlarged diameter portions 563Sa and 563Ta) with the first and second rivets 203S and 203T inserted into first and second rivet holes 191S and 191T, respectively. The first and second rivet holes 191S and 191T are provided in the bottom portions of the first and second rivet-side enlarged diameter portions 563Sa and 563Ta, respectively.

The first and second discharge-opening-side enlarged diameter portions 563Sb and 563Tb are formed by enlarging the diameter (width) of the first and second groove portions 563S and 563T, respectively. That is, the first and second discharge-opening-side enlarged diameter portions 563Sb and 563Tb have a diameter (width) which is larger than that of the first and second groove portions 563S and 563T, respectively. Consequently, a path of compressed refrigerant gas is formed through which the compressed refrigerant gas discharged from the first and second discharge openings 190S and 190T ejects pushing open the first and second discharge valves 200S and 200T, respectively.

At the first and second rivet-side enlarged diameter portions 563Sa and 563Ta, the first and second groove portions 563S and 563T are enlarged to have a diameter (width) Ha which is larger than that of the first and second groove portions 563S and 563T. This prevents a punch P of a swaging machine (not shown) from interfering with an inner wall portions of the first and second rivet-side enlarged diameter portions 563Sa and 563Ta, when swaging, i.e. pressing or applying pressure by the punch P to cause plastic deformation, first and second swaging portions 203Sa and 203Ta of the first and second rivets 203S and 203T. As illustrated in FIG. 9, when the first and second swaging portions 203Sa and 203Ta are swaged, the swaging machine presses a tip N of the punch P against the first and second swaging portions 203Sa and 203Ta and make the punch P perform a rosette-like axial motion (motion of moving on a conical petal-like trajectory Y) about the central axis Z of the first and second rivets 203S and 203T in order to swage the first and second swaging portions 203Sa and 203Ta.

The thickness $t_s$ of the bottom portions of the first and second groove portions 563S and 563T (including the first and second rivet-side enlarged diameter portions 563Sa and 563Ta and the first and second discharge-opening-side enlarged diameter portions 563Sb and 563Tb) is made as thin as possible so as to prevent backflow of the compressed refrigerant gas trapped in the first and second discharge openings 190S and 190T toward first and second operating chambers 130S and 130T (see FIG. 2) and prevent the volumetric efficiency of refrigerant compression from decreasing.

In a conventional hermetic type compressor (rotary compressor) including a cylinder chamber formed from a cylinder and a bearing, wherein refrigerant gas drawn into the cylinder chamber is compressed, and the refrigerant gas is discharged by opening a discharge valve provided in the bearing, it is known to a skilled person in the art that a hermetic type compressor (rotary compressor) includes a recessed portion (groove portion) formed in the bearing, a valve limiter press-fitted into the recessed portion (groove portion), and the discharge valve inserted between the valve limiter and the bearing recessed portion (groove portion) such that it is openable and closable. The valve limiter and the discharge valve each include a mounting hole, and a mounting bolt for mounting the bearing on the cylinder is inserted into the mounting holes so that the valve limiter and the discharge valve are fixedly mounted on the cylinder together with the bearing (for example, see Japanese Laid-open Patent Publication No. 08-200264).

However, according to the conventional technology described with reference to FIG. 7 to FIG. 9, as illustrated in FIG. 8, each of the bottom portions of the first and second rivet-side enlarged diameter portions 563Sa and 563Ta has a small thickness ts in entire area of the bottom portions. That is, the area having the small thickness ts is larger than the first and second discharge valves 200S and 200T and the first and second discharge-valve limiters 201S and 201T are attached to the bottom portions with the first and second rivets 203S and 203T, respectively. Therefore, when each of the first and second swaging portions 203Sa and 203Ta of the first and second rivets 203S and 203T is swaged by using the punch P, the bottom portion is deflected due to the swage load and the flatness deteriorates. Thus, the adhesiveness and the airtightness between the lower and upper end plates 160S and 160T and first and second cylinders 121S and 121T decrease.

The present invention is achieved in view of the above and has an object to obtain a rotary compressor that is capable of performing a rosette-like axial motion of a punch by a swage and includes lower and upper end plates in which bottom portions of first and second rivet-side enlarged diameter portions are not deflected.

SUMMARY OF THE INVENTION

It is an object of the present invention to at least partially solve the problems in the conventional technology.

According to an aspect of the present invention, a rotary compressor includes a hermetic vertical compressor housing that includes a discharge unit that discharges refrigerant provided in an upper portion of the housing, and a suction unit for the refrigerant is provided in a lower portion of side surface of the housing;

a compressing unit that is arranged in a lower portion of the compressor housing and includes an annular cylinder, an end plate that includes a bearing portion and a discharge valve portion and closes an end portion of the cylinder, an annular piston that is fitted to an eccentric portion of a rotating shaft supported by the bearing portion, revolves in the cylinder along a cylinder inner-wall of the cylinder, and forms an operating chamber between the annular piston and the cylinder inner-wall, and a vane that comes into contact with the annular piston by projecting into the operating chamber from an inside of a vane groove of the cylinder and divides the operating chamber into a suction chamber and a compression chamber, and that draws a refrigerant through the suction unit and discharges a refrigerant from the discharge unit through an inside of the compressor housing; and a motor that is arranged in an upper portion of the compressor housing and drives the compressing unit via the rotating shaft.

The end plate has a groove portion accommodating the discharge valve portion that includes a reed valve type discharge valve and a discharge-valve limiter that are attached to the groove portion with a rivet, and the groove portion has a rivet-side enlarged diameter portion which is formed into a semicircular step shape, and a diameter of the rivet-side enlarged diameter portion other than a bottom side thereof is larger than a diameter of the bottom side.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a rotary compressor according to the present invention will be described in detail with reference to the drawings. This invention is not limited to the embodiment.

Embodiment

Figure 1:
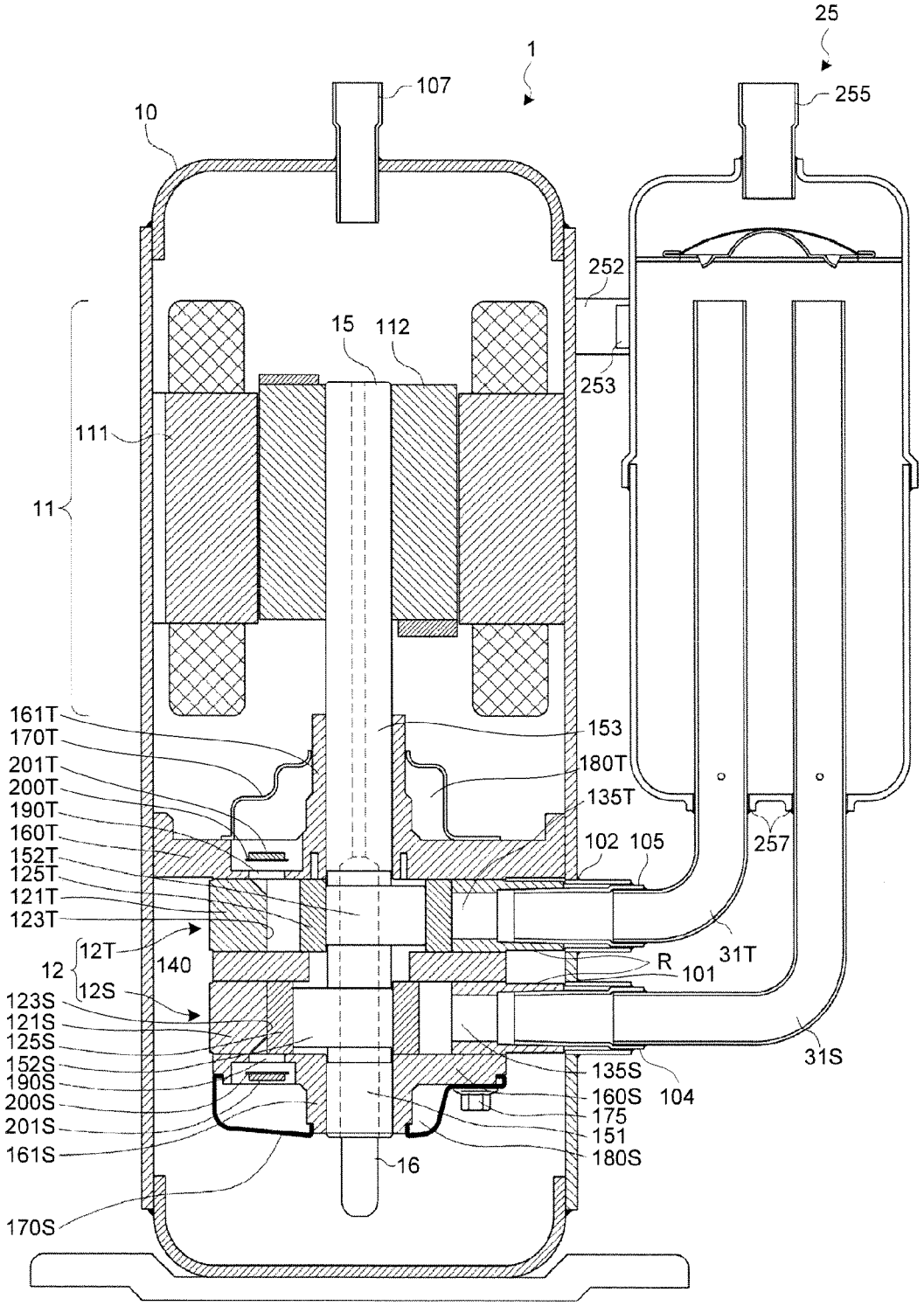
FIG. 1 is a vertical or longitudinal cross-sectional view illustrating an embodiment of a rotary compressor according to the present invention.
Figure 2:
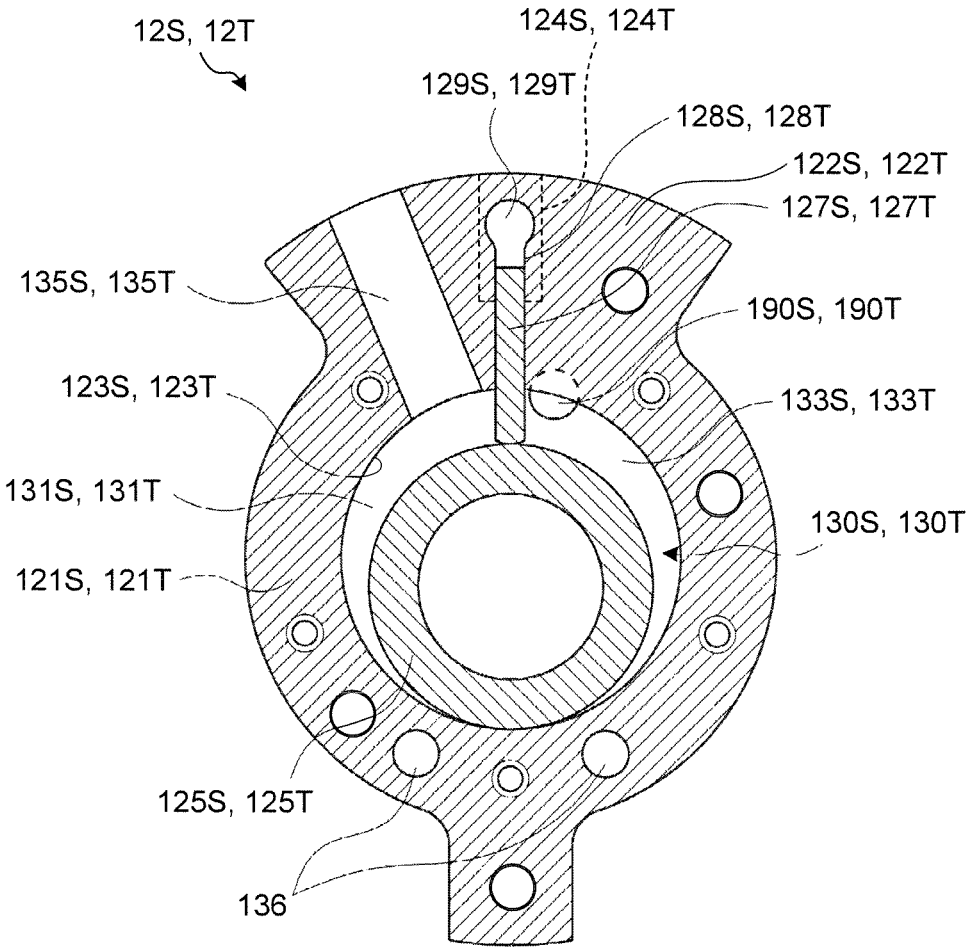
FIG. 2 is a horizontal or transverse cross-sectional view of first and second compressing units according to the embodiment as viewed from above.

FIG. 1 is a vertical or longitudinal cross-sectional view illustrating the embodiment of a rotary compressor according to the present invention, and FIG. 2 is a horizontal or transverse cross-sectional view of first and second compressing units according to the embodiment as viewed from above.

As illustrated in FIG. 1, a rotary compressor 1 in the embodiment includes a compressing unit 12, which is arranged in the lower portion of a hermetic vertical cylindrical compressor housing 10, and a motor 11, which is arranged in the upper portion of the compressor housing 10 and drives the compressing unit 12 via a rotating shaft 15.

A stator 111 of the motor 11 is cylindrically shaped and is shrink-fitted and fixed to the inner periphery of the compressor housing 10. A rotor 112 of the motor 11 is arranged in the cylindrical stator 111 and is shrink-fitted and fixed to the rotating shaft 15 connecting the motor 11 and the compressing unit 12 mechanically.

The compressing unit 12 includes a first compressing unit 12S and a second compressing unit 12T that is arranged parallel to the first compressing unit 12S and is stacked on the upper side of the first compressing unit 12S. As illustrated in FIG. 2, the first and second compressing units 12S and 12T include annular first and second cylinders 121S and 121T, respectively. The first and second cylinders 121S and 121T have first and second side protrusions, respectively. First and second suction openings 135S and 135T and first and second vane grooves 128S and 128T are radially provided in the first and second side protrusions, respectively.

As illustrated in FIG. 2, circular first and second cylinder inner-walls 123S and 123T are formed in the first and second cylinders 121S and 121T, respectively, concentrically with the rotating shaft 15 of the motor 11. First and second annular pistons 125S and 125T, which have an outer diameter smaller than the inner diameter of the cylinder, are arranged on the inner side of the first and second cylinder inner-walls 123S and 123T, respectively. First and second operating chambers 130S and 130T, which draw refrigerant gas and discharge the refrigerant gas after compression, are formed between the first and second cylinder inner-walls 123S and 123T and the first and second annular pistons 125S and 125T, respectively.

In the first and second cylinders 121S and 121T, the first and second vane grooves 128S and 128T, which extend over the entire height of the cylinder, are formed radially from the first and second cylinder inner-walls 123S and 123T, respectively. Plate-shaped first and second vanes 127S and 127T are slidably fitted in the first and second vane grooves 128S and 128T, respectively.

As illustrated in FIG. 2, first and second spring holes 124S and 124T are formed in inner portions of the first and second vane grooves 128S and 128T, respectively, such that they communicate with the first and second vane grooves 128S and 128T from the outer peripheral portions of the first and second cylinders 121S and 121T, respectively. Vane springs (not shown) that press back surfaces of the first and second vanes 127S and 127T are inserted into the first and second spring holes 124S and 124T, respectively. When the rotary compressor 1 is started, the first and second vanes 127S and 127T project into the first and second operating chambers 130S and 130T from the inside of the first and second vane grooves 128S and 128T due to the repulsive force of the vane springs, respectively, and the projecting ends of the first and second vanes 127S and 127T come into contact with the outer peripheries of the first and second annular pistons 125S and 125T, respectively, whereby the first and second operating chambers 130S and 130T are divided into first and second suction chambers 131S and 131T and first and second compression chambers 133S and 133T by the first and second vanes 127S and 127T, respectively.

In the first and second cylinders 121S and 1211, first and second pressure introducing paths 129S and 129T are formed, respectively. The first and second pressure introducing paths 129S and 129T communicate the inner portions of the first and second vane grooves 128S and 128T with the inside of the compressor housing 10 through openings R illustrated in FIG. 1 to introduce refrigerant gas compressed in the compressor housing 10 and apply a back pressure to the first and second vanes 127S and 127T due to the pressure of the refrigerant gas, respectively.

In the first and second cylinders 121S and 121T, the first and second suction openings 135S and 135T are formed, respectively. The first and second suction openings 135S and 135T cause the first and second suction chambers 131S and 131T and the outside to communicate with each other so as to draw refrigerant into the first and second suction chambers 131S and 131T from the outside, respectively.

Moreover, as illustrated in FIG. 1, an intermediate partition plate 140 is arranged between the first cylinder 121S and the second cylinder 121T so as to separate and close the first operating chamber 130S of the first cylinder 121S and the second operating chamber 130T of the second cylinder 121T. A lower end plate 160S is arranged in the lower end portion of the first cylinder 121S so as to close the first operating chamber 130S of the first cylinder 121S. An upper end plate 160T is arranged in the upper end portion of the second cylinder 121T so as to close the second operating chamber 130T of the second cylinder 121T.

A sub bearing portion 161S is formed in the lower end plate 160S and a sub shaft portion 151 of the rotating shaft 15 is rotatably supported by the sub bearing portion 161S. A main bearing portion 161T is formed in the upper end plate 160T and a main shaft portion 153 of the rotating shaft 15 is rotatably supported by the main bearing portion 161T.

The rotating shaft 15 includes a first eccentric portion 152S and a second eccentric portion 152T whose phases are shifted by 180° from each other. The first eccentric portion 152S is rotatably fitted to the first annular piston 125S of the first compressing unit 12S and the second eccentric portion 152T is rotatably fitted to the second annular piston 125T of the second compressing unit 12T.

When the rotating shaft 15 rotates, the first and second annular pistons 125S and 125T revolve counterclockwise in FIG. 2 in the first and second cylinders 121S and 121T along the first and second cylinder inner-walls 123S and 123T, respectively. In accordance with the revolutions, the first and second vanes 127S and 127T reciprocate. The volume of the first and second suction chambers 131S and 131T and the first and second compression chambers 133S and 133T changes continuously due to the motion of the first and second annular pistons 125S and 125T and the first and second vanes 127S and 127T, whereby the compressing unit 12 continuously draws, compresses, and then discharges the refrigerant gas.

As illustrated in FIG. 1, a lower muffler cover 170S is arranged on the lower side of the lower end plate 160S such that a lower muffler chamber 180S is formed between the lower muffler cover 170S and the lower end plate 160S. The first compressing unit 12S is open to the lower muffler chamber 180S. In other words, a first discharge opening 190S (see FIG. 2), which causes the first compression chamber 133S of the first cylinder 121S and the lower muffler chamber 180S to communicate with each other, is provided near the first vane 127S of the lower end plate 160S. A reed valve type first discharge valve 200S, which prevents backflow of the compressed refrigerant gas, is arranged at the first discharge opening 190S.

The lower muffler chamber 180S is an annular chamber and is part of the communication path that causes the discharge side of the first compressing unit 12S to communicate with the inside of an upper muffler chamber 180T through a refrigerant path 136 (see FIG. 2) that passes through the lower end plate 160S, the first cylinder 121S, the intermediate partition plate 140, the second cylinder 121T, and the upper end plate 160T. The lower muffler chamber 180S reduces the pressure pulsation of the discharged refrigerant gas. Moreover, a first discharge-valve limiter 201S is arranged on the first discharge valve 200S and is fixed with a rivet together with the first discharge valve 200S to limit the deflection opening amount of the first discharge valve 200S. The first discharge opening 190S, the first discharge valve 200S, and the first discharge-valve limiter 201S compose a first discharge valve portion of the lower end plate 160S.

As illustrated in FIG. 1, an upper muffler cover 170T is arranged on the upper side of the upper end plate 160T such that the upper muffler chamber 180T is formed between the upper muffler cover 170T and the upper end plate 160T. A second discharge opening 190T (see FIG. 2), which causes the second compression chamber 1331 of the second cylinder 121T and the upper muffler chamber 180T to communicate with each other, is provided near the second vane 127T of the upper end plate 160T. A reed valve type second discharge valve 200T, which prevents backflow of the compressed refrigerant gas, is arranged at the second discharge opening 1901. Moreover, a second discharge-valve limiter 201T is arranged on the second discharge valve 200T and is fixed with a rivet together with the second discharge valve 200T to limit the deflection opening amount of the second discharge valve 200T. The upper muffler chamber 180T reduces the pressure pulsation of the discharged refrigerant. The second discharge opening 190T, the second discharge valve 200T, and the second discharge-valve limiter 2011 compose a second discharge valve portion of the upper end plate 160T. The details of the first and second discharge valve portions will be described later.

The first cylinder 121S, the lower end plate 160S, the lower muffler cover 170S, the second cylinder 121T, the upper end plate 160T, the upper muffler cover 170T, and the intermediate partition plate 140 are fastened together by using a plurality of through bolts 175 or the like. In the compressing unit 12 formed by fastening the above components together by using the through bolts 175 or the like, the outer peripheral portion of the upper end plate 160T is secured to the compressor housing 10 by spot welding, whereby the compressing unit 12 is fixed to the compressor housing 10.

First and second through holes 101 and 102 are provided in the outer peripheral wall of the cylindrical compressor housing 10 such that they are axially spaced apart from each other. The first and second through holes 101 and 102 are arranged sequentially from the lower portion in the order such that first and second suction pipes 104 and 105 pass through the first and second through holes 101 and 102, respectively. Moreover, an accumulator 25 composed of an independent cylindrical airtight container is held on the outside portion of the compressor housing 10 by an accumulator holder 252 and an accumulator band 253.

A connection pipe 255 connected to an evaporator in the refrigeration cycle is connected to the center of the top of the accumulator 25, and first and second low-pressure communication pipes 31S and 31T are connected to bottom-portion through holes 257 provided in the bottom portion of the accumulator 25. One end of each of the first and second low-pressure communication pipes 31S and 31T extends to the upper portion in the accumulator 25, and the other end of each of the first and second low-pressure communication pipes 31S and 31T is connected to the first and second suction pipes 104 and 105, respectively.

The first and second low-pressure communication pipes 31S and 31T, which introduce low-pressure refrigerant in a refrigeration cycle to the first and second compressing units 12S and 12T via the accumulator 25, are connected to the first and second suction openings 135S and 135T (see FIG. 2) in the first and second cylinders 121S and 121T via the first and second suction pipes 104 and 105 that are suction units, respectively. In other words, the first and second suction openings 135S and 135T are connected to the evaporator in the refrigeration cycle in parallel.

A discharge pipe 107 as a discharge unit is connected to the top of the compressor housing 10. The discharge pipe 107 is connected to the refrigeration cycle and discharges high-pressure refrigerant gas toward the condenser in the refrigeration cycle. In other words, the first and second discharge openings 190S and 190T are connected to the condenser in the refrigeration cycle.

Lubricating oil is encapsulated up to about the height of the second cylinder 121T in the compressor housing 10. Moreover, lubricating oil is pumped from an oil supply pipe 16 attached to the lower end portion of the rotating shaft 15 by a vane pump (not shown) inserted into the lower portion of the rotating shaft 15 and circulates in the compressing unit 12, thereby lubricating sliding parts and sealing the minute gaps in the compressing unit 12.

Figure 3:
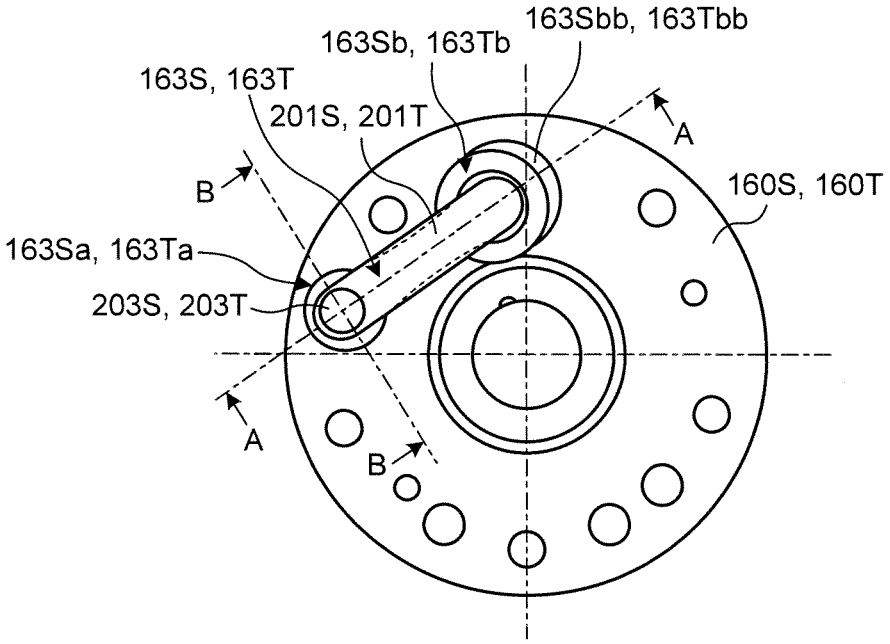
FIG. 3 is a partial plan view of upper and lower end plates to which first and second discharge valves and first and second discharge-valve limiters according to the embodiment are attached, respectively.
Figure 4:
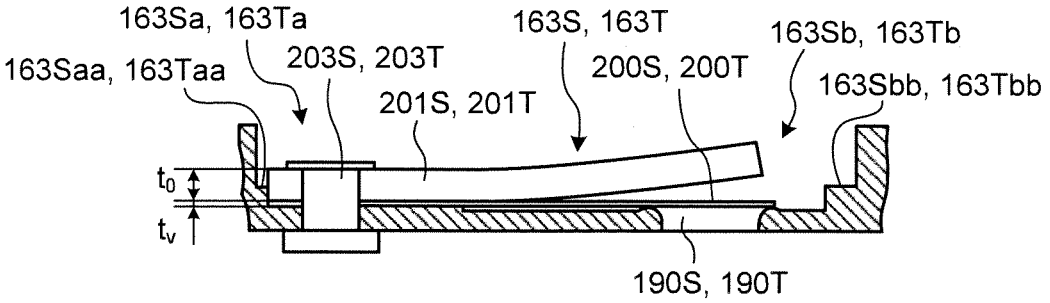
FIG. 4 is a partial cross-sectional view taken along line A-A in FIG. 3.
Figure 5:
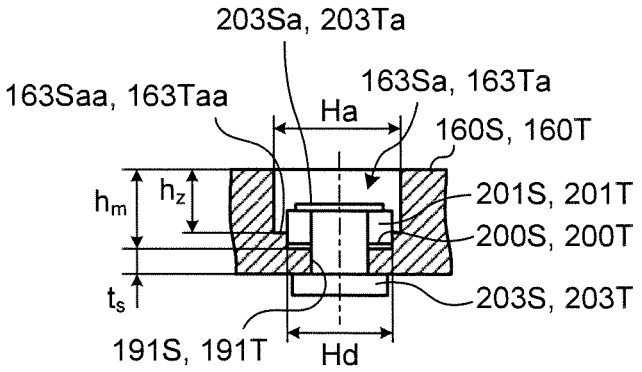
FIG. 5 is a partial cross-sectional view taken along line B-B in FIG. 3.
Figure 6:
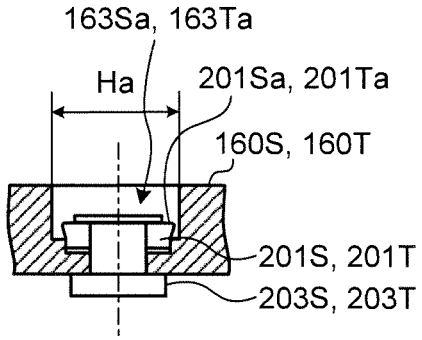
FIG. 6 is a diagram that is similar to FIG. 5 and illustrates a state where the first and second discharge-valve limiters are deflected by swaging.
Figure 7:
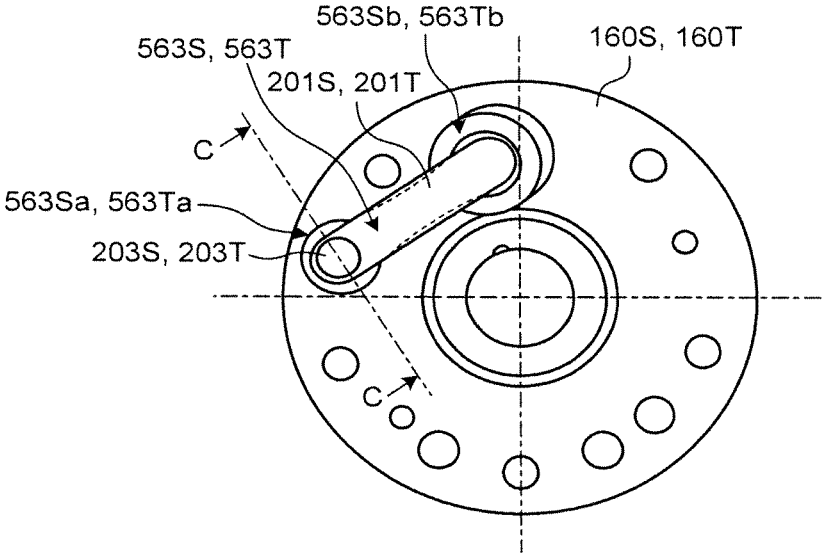
FIG.7 PRIOR ART
FIG. 7 is a partial plan view of conventional upper and lower end plates to which first and second discharge valves and first and second discharge-valve limiters are attached, respectively.
Figure 8:
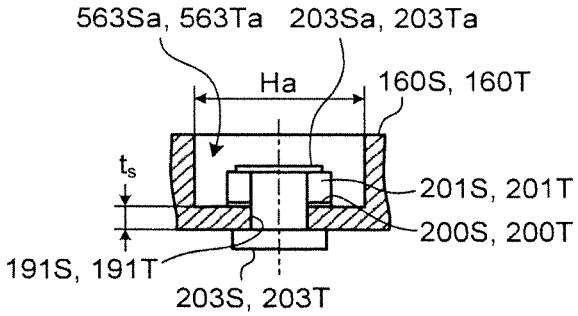
FIG.8 PRIOR ART
FIG. 8 is a partial cross-sectional view taken along line C-C in FIG. 7.

Next, an explanation will be given of the first and second discharge valve portions, which are characteristic configurations of the rotary compressor 1 in the embodiment, with reference to FIG. 3 to FIG. 6. FIG. 3 is a partial plan view of the upper and lower end plates to which the first and second discharge valves and the first and second discharge-valve limiters according to the embodiment are attached, respectively. FIG. 4 is a partial cross-sectional view taken along line A-A in FIG. 3. FIG. 5 is a partial cross-sectional view taken along line B-B in FIG. 3. FIG. 6 is also a partial cross-sectional view taken along line B-B in FIG. 3 similar to FIG. 5. FIG. 6 illustrates a state where the first and second discharge-valve limiters are deflected by swaging.

As illustrated in FIG. 3 to FIG. 6, first and second groove portions 163S and 163T are formed in the lower end plate 1605 and the upper end plate 160T of the compressing unit 12 (see FIG. 1) of the rotary compressor 1, respectively. The first and second groove portions 163S and 163T accommodate the reed valve type first and second discharge valves 200S and 200T that open and close the first and second discharge openings 190S and 190T (see FIG. 4) and the first and second discharge-valve limiters 201S and 201T, respectively. Furthermore, the first and second groove portions 163S and 163T are formed such that the first and second discharge valves 200S and 200T and the first and second discharge-valve limiters 201S and 2011 are attached to the bottom portions thereof with first and second rivets 203S and 2031, respectively.

The diameter (width) of the first and second groove portions 163S and 163T is enlarged on the side of the first and second discharge openings 190S and 190T so as to form first and second discharge-opening-side enlarged diameter portions 163Sb and 163Tb, respectively. The diameter (width) of the first and second groove portions 163S and 163T is also enlarged on the side of the first and second rivets 203S and 203T so as to form first and second rivet-side enlarged diameter portions 163Sa and 163Ta, respectively.

As illustrated in FIG. 5, the first and second discharge valves 200S and 200T and the first and second discharge-valve limiters 201S and 201T are attached to the bottom portions of the first and second groove portions 163S and 163T with the first and second rivets 203S and 203T, respectively. At this time, the first and second rivets 203S and 203T are inserted into first and second rivet holes 191S and 191T of the first and second rivet-side enlarged diameter portions 163Sa and 163Ta and the rivet holes of the first and second discharge valves 200S and 200T and the first and second discharge-valve limiters 201S and 201T, respectively.

The diameter (width) of the first and second discharge-opening-side enlarged diameter portions 163Sb and 163Tb is enlarged. Therefore, a path is formed for compressed refrigerant gas that pushes open the reed valve type first and second discharge valves 200S and 200T and is discharged or ejected from the first and second discharge openings 190S and 190T, respectively. Step portions 163Sbb and 163Tbb are formed in the first and second discharge-opening-side enlarged diameter portions 163Sb and 163Tb on the side opposite to the side on which the first and second rivets 203S and 203T are inserted, respectively, whereby the flow path is further enlarged toward the side opposite to the first and second rivet side.

As illustrated in FIG. 5, the first and second rivet-side enlarged diameter portions 163Sa and 163Ta of the first and second groove portions 163S and 163T are each formed into a semicircular shape with a step (hereinafter, semicircular step), when viewed from openings of the first and second groove portions 163S and 163T toward the bottoms thereof, such that the bottom side has smaller diameter (width) than portions other than the bottom side. The diameter (width) Hd of the bottom side of the first and second rivet-side enlarged diameter portions 163Sa and 163Ta is about 0.2 mm larger than the width of the first and second discharge-valve limiters 201S and 201T.

Figure 9:
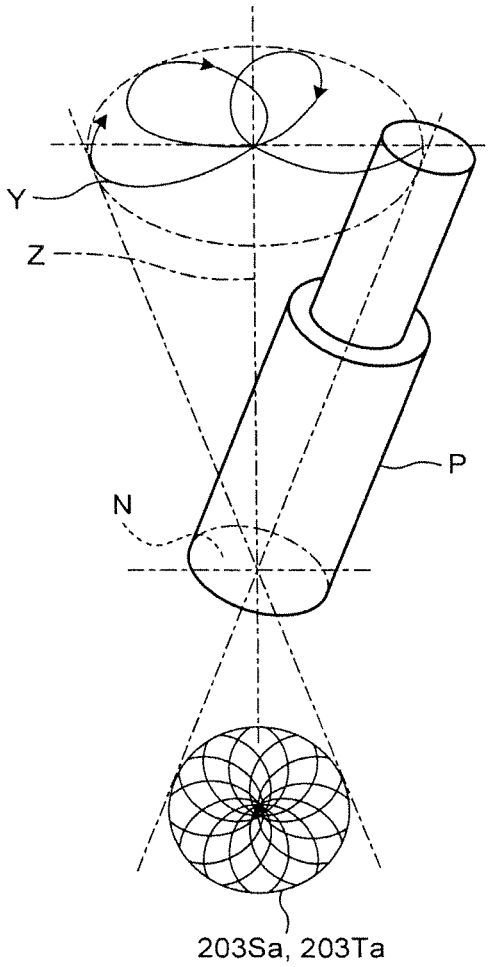
FIG.9 PRIOR ART
FIG. 9 is a perspective view illustrating a rosette-like axial motion of a punch by a swaging machine.

The diameter (width) Ha of the first and second rivet-side enlarged diameter portions 163Sa and 163Ta other than the bottom side is 30 to 40% larger than the diameter (width) Hd of the bottom side. Therefore, when the punch P (see FIG. 9) is caused to perform a rosette-like axial motion (motion of moving on a conical petal-like trajectory Y) about the central axis Z of the first and second rivets 203S and 203T in order to swage first and second swaging portions 203Sa and 203Ta by a swage, the punch P does not interfere with the inner wall portions of the first and second rivet-side enlarged diameter portions 163Sa and 163Ta.

The width $t_s$ of the bottom portions of the first and second groove portions 163S and 163T (including the first and second rivet-side enlarged diameter portions 163Sa and 163Ta and the first and second discharge-opening-side enlarged diameter portions 163Sb and 163Tb) are made as thin as possible so as to prevent backflow of the compressed refrigerant gas trapped in the first and second discharge openings 190S and 190T (see FIG. 4) toward the first and second operating chambers 130S and 130T (see FIG. 2) and to prevent the volumetric efficiency of refrigerant compression from decreasing.

As illustrated in FIG. 5, when $h_m$ is the depth down to the bottom portion of the first and second groove portions 163S and 163T (including the first and second rivet-side enlarged diameter portions 163Sa and 163Ta), $h_z$ is the depth down to step portions 163Saa and 163Taa of the semicircular step of the first and second rivet-side enlarged diameter portions 163Sa and 163Ta, $t_v$ (see FIG. 4) is the thickness of the first and second discharge valves 200S and 200T, and $t_o$ is the thickness of the first and second discharge-valve limiters 201S and 201T, the relationship $h_m-(t_v+0.4t_o)\geq h_z\geq h_m-(t_v+0.8t_o)$ is satisfied. In other words, the height from the bottom portions of the first and second rivet-side enlarged diameter portions 163Sa and 163Ta to the step portions 163Saa and 163Taa is a height that is 40 to 80% of the thickness $t_o$ of the first and second discharge-valve limiters 201S and 201T (the thickness $t_v$ of the first and second discharge valves 200S and 200T is small and therefore may be negligible).

According to the configurations of the first and second discharge valve portions in the embodiment described above, the diameter (width) Hd of the bottom side of the first and second rivet-side enlarged diameter portions 163Sa and 163Ta is reduced to be substantially equal to the width of the first and second discharge-valve limiters 201S and 201T. Therefore, when the first and second swaging portions 203Sa and 203Ta of the first and second rivets 203S and 203T are swaged by using the punch P, even if a swage load is applied, there is no bending stress and therefore the bottom portion is not deflected.

Moreover, because the diameter (width) Ha of the portions of the first and second rivet-side enlarged diameter portions 163Sa and 163Ta other than the bottom side is made larger than the diameter (width) Hd of the bottom side by 30 to 40%, a rosette-like axial motion of the punch can be performed by a swage.

Moreover, as illustrated in FIG. 6, when the first and second swaging portions 203Sa and 203Ta of the first and second rivets 203S and 203T are swaged by using the punch P, even if upper portions 201Sa and 201Ta of the first and second discharge-valve limiters 201S and 201T are collapsed and protrude to the side portion, because the upper portions 201Sa and 201Ta are located above the step portions 163Saa and 163Taa of the semicircular step of the first and second rivet-side enlarged diameter portions 163Sa and 163Ta, the lower end plates 160S and 160T are not deflected by pushing the inner walls of the first and second rivet-side enlarged diameter portions 163Sa and 163Ta apart.

An explanation has been given above of the twin rotary compressor 1 that includes the first and second compressing units 12S and 12T as the embodiment of the present invention; however, the present invention can be applied also to a single rotary compressor that includes one compressing unit, a two-stage compression rotary compressor that further compresses refrigerant discharged from a first compressing unit by a second compressing unit, or the like.

According to the present invention, an effect is obtained where a rosette-like axial motion of a punch can be performed by a swage and the bottom portions of the first and second rivet-side enlarged diameter portions are not deflected.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A rotary compressor comprising:

a hermetic vertical compressor housing including:

a discharge unit that discharges refrigerant provided in an upper portion of the housing; and a suction unit for the refrigerant is provided in a lower portion of a side surface of the housing;

a compressing unit that is arranged in a lower portion of the compressor housing, the compressing unit including:

an annular cylinder;

an end plate that includes a bearing portion and a discharge valve portion and closes an end portion of the cylinder;

an annular piston that is fitted to an eccentric portion of a rotating shaft supported by the bearing portion, revolves in the cylinder along a cylinder inner-wall of the cylinder, and forms an operating chamber between the annular piston and the cylinder inner-wall; and a vane that comes into contact with the annular piston by projecting into the operating chamber from an inside of a vane groove of the cylinder and divides the operating chamber into a suction chamber and a compression chamber, and that draws a refrigerant through the suction unit and discharges a refrigerant from the discharge unit through an inside of the compressor housing; and a motor that is arranged in an upper portion of the compressor housing and drives the compressing unit via the rotating shaft, wherein the end plate has a groove portion accommodating the discharge valve portion that includes a reed valve type discharge valve and a discharge-valve limiter that are attached to the groove portion with a rivet, the groove portion has a rivet-side enlarged diameter portion which is formed into a semicircular step shape, and a diameter of the rivet-side enlarged diameter portion other than a bottom side of the rivet-side enlarged diameter portion is larger than a diameter of the bottom side, and a relationship $h_m-(t_v+0.4t_o)\geq h_z\geq h_m-(t_v+0.8t_o)$ is satisfied, where $h_m$ is a depth down to a bottom of the groove portion, $h_z$ is a depth down to a step portion of the semicircular step, $t_v$ is a thickness of the discharge valve, and $t_o$ is a thickness of the discharge-valve limiter.

* * * * *